US006738012B1

(12) United States Patent
Kirkpatrick

(10) Patent No.: US 6,738,012 B1
(45) Date of Patent: May 18, 2004

(54) PROTECTING COMMERCIAL AIRLINERS FROM MAN PORTABLE MISSILES

(75) Inventor: Philip L. Kirkpatrick, Dumont, NJ (US)

(73) Assignee: Honeywell Industrial Inc.

( * ) Notice: Subject to any disclaimer, the term of this patent is extended or adjusted under 35 U.S.C. 154(b) by 0 days.

(21) Appl. No.: 10/428,652

(22) Filed: May 2, 2003

(51) Int. Cl.[7] ..... G01S 13/86

(52) U.S. Cl. ..... 342/67; 89/1.11; 342/20; 342/30; 342/16; 342/126; 342/90; 342/97; 348/169; 250/243.6

(58) Field of Search ..... 89/1.11; 342/20, 342/30, 16, 67, 126, 90, 97; 348/169; 250/203.6

(56) References Cited

U.S. PATENT DOCUMENTS

| | | | | | |
|---|---|---|---|---|---|
| 3,974,740 | A | * | 8/1976 | Billottet et al. | 89/41.07 |
| 5,122,801 | A | * | 6/1992 | Hughes | 342/13 |
| 5,198,607 | A | * | 3/1993 | Livingston et al. | 89/1.11 |
| 5,206,452 | A | * | 4/1993 | Stamper et al. | 89/1.11 |
| 5,458,041 | A | * | 10/1995 | Sun et al. | 89/1.11 |
| 5,464,174 | A | * | 11/1995 | Laures | 244/3.11 |
| 5,471,213 | A | * | 11/1995 | Hergesheimer | 342/67 |
| 5,485,384 | A | * | 1/1996 | Falconnet | 701/207 |
| 5,495,787 | A | * | 3/1996 | Boyer, III | 89/1.11 |
| 5,497,705 | A | * | 3/1996 | Bredy et al. | 102/427 |
| 5,600,434 | A | * | 2/1997 | Warm et al. | 356/139.08 |
| 5,662,291 | A | * | 9/1997 | Sepp et al. | 244/3.13 |
| 5,747,720 | A | * | 5/1998 | Schnurr et al. | 89/1.11 |
| 6,014,922 | A | * | 1/2000 | Livingston | 89/1.11 |
| 6,324,955 | B1 | * | 12/2001 | Andersson et al. | 89/1.11 |
| 6,559,933 | B1 | * | 5/2003 | Kirkpatrick et al. | 356/28.5 |
| 6,584,879 | B2 | * | 7/2003 | Gorman | 89/1.11 |
| 6,626,396 | B2 | * | 9/2003 | Secker | 244/3.16 |
| 6,674,520 | B2 | * | 1/2004 | Hicks et al. | 356/139.04 |

FOREIGN PATENT DOCUMENTS

| | | | |
|---|---|---|---|
| DE | DT2031883 | * | 1/1972 |

* cited by examiner

*Primary Examiner*—Michael J. Carone
*Assistant Examiner*—John Richardson
(74) *Attorney, Agent, or Firm*—Kurt Luther; Jamie W. Falk

(57) ABSTRACT

A commercial airliner (10) carries a sensor that detects a characteristic (21) associated with a man portable missile (20). Raw sensor data is transmitted via a wireless data-link (41) to ground stations (31–33) that process the airliner transmission and determine both the presence of the missile and a precise aircraft position. Countermeasures are fired to detonate within a close proximity of airliner in order to divert the detected missile.

8 Claims, 7 Drawing Sheets

PROTECTING COMMERCIAL AIRLINERS FROM MAN PORTABLE MISSILES

BACKGROUND OF THE INVENTION

1. Technical Field

The present invention relates to an appartus and method for protecting commercial airliners from man portable missiles.

2. Background Art

There is a growing concern that terrorists will use shoulder-fired, heat-seeking missiles to shoot down commercial airliners. Many portable heat-seeking missiles are inexpensive, relatively easy to obtain on the black market and extremely dangerous. Afghan rebels used U.S.-supplied Stinger missiles to destroy Soviet jets and attack helicopters in the 1980s. Terrorists have recently tried to use older, Soviet-made SA-7 shoulder-fired missiles to bring down U.S. military aircraft in Saudi Arabia and an Israeli airliner in Kenya.

Neighborhoods or other areas where terrorists could hide and attack commercial jet airliners as they land or take off surround many of the world's civilian airports. Jets that routinely cruise at 500 mph or faster fly much more slowly near the ground. A Boeing 737 typically flies both take-off climb-out and landing approaches at 150–160 mph, for example. Even slow shoulder-fired missiles can fly almost 1,000 mph, more than fast enough to overtake a jet.

A heat-seeking missile operates much like a point-and-shoot camera. The operator aims at one of a plane's engines, which are heat sources, "locks on" the target for about six seconds, and fires. The missile has an infrared sensor that "sees" the aircraft's heat plume; a computer navigational system guides the weapon to an engine. A commercial pilot would almost never see a missile coming and could generally react only after the missile hit an engine or exploded nearby.

Certain US Air Force aircraft, such as C-17 cargo jets, have equipment to thwart attacks from portable heat-seeking missiles. It is known in the art to protect such aircraft by providing, on the aircraft, missile-detecting sensors coupled to a processor, which determines whether a missile is present, and flare and or chaff dispensers that explode flares or chaff to divert the missile away from the aircraft. However, the cost to install and maintain such equipment on many civilian aircraft would be very expensive, the missile detection algorithms are military sensitive knowledge, and it would be both unwise and unacceptable to install a pyrotechnic on a civilian aircraft.

There are roughly 5,000 commercial aircraft owned by U.S. carriers and 10,000 more in the rest of the world. There is a need to protect these commercial airliners from man portable missiles.

SUMMARY OF THE INVENTION

In accordance with my invention, a missile sensor head is mounted on an airliner and transmits raw sensor video to a series of ground stations. The carrier frequency for this transmission provides a very precise timing signal that allows the ground stations to track the aircraft to centimeter position accuracy.

The ground stations track the aircraft's position and process the raw sensor video. A gun turret adapted for accurately placing and detonating flare cartridges is positioned on the ground adjacent to the runway and tracks the aircraft as it flies through a protected zone. When the ground station determines that a missile is being viewed by the airliner-mounted missile sensor head, the gun turret lays down a predetermined pattern of exploding flares to divert the missile away from the airliner.

In a further embodiment of my invention, each airliner is equipped with multiple aircraft sensor packages and each aircraft sensor package transmits on a unique carrier frequency allowing the ground stations to determine both precise airliner position and pitch, roll and heading attitude. These aircraft sensor packages are remotely controlled by air traffic control and only transmit while the airliner is in a protected area. In a preferred embodiment of my invention, the carrier frequency is also remotely selected by air traffic control and is within the already allocated radio navigation frequency band of 108.000 to 117.975 MHz.

Precise aircraft location is obtained by tracking the carrier phase of a transmitted signal in a manner similar to that used for global positioning system (GPS) carrier phase tracking. In the present invention, three receivers are phase tracking a single transmitter whereas in GPS surveying, a single receiver tracks three transmitters. Kinematic phase tracking requires that the receivers 'lock on' to the transmitted signal and continuously monitor phase shift and full-wave cycle count.

Using a radio frequency (RF) signal to measure a physical distance, where that distance is less than less the wavelength of the RF signal by measuring phase shift using of a transmitted signal against a reference oscillator is very well known. Kinematic phase tracking is a technique that not only measures the fractional part, relative to reference RF signal, of a distance, but also 'counts' the number of complete RF cycles by constantly monitoring the changing phase shift of RF signal and whether the distance is increasing or decreasing. Kinematic phase tracking requires that each ground station count the whole and partial RF cycles, where each RF cycle corresponds to a wavelength, starting from a known distance. In my invention this known distance for each ground station corresponds to the distance between the aircraft sensor package and each ground station while the aircraft is located at a 'survey position'.

LIST OF REFERENCE NUMBERS FOR THE MAJOR ELEMENTS IN THE DRAWING

Figure 1:
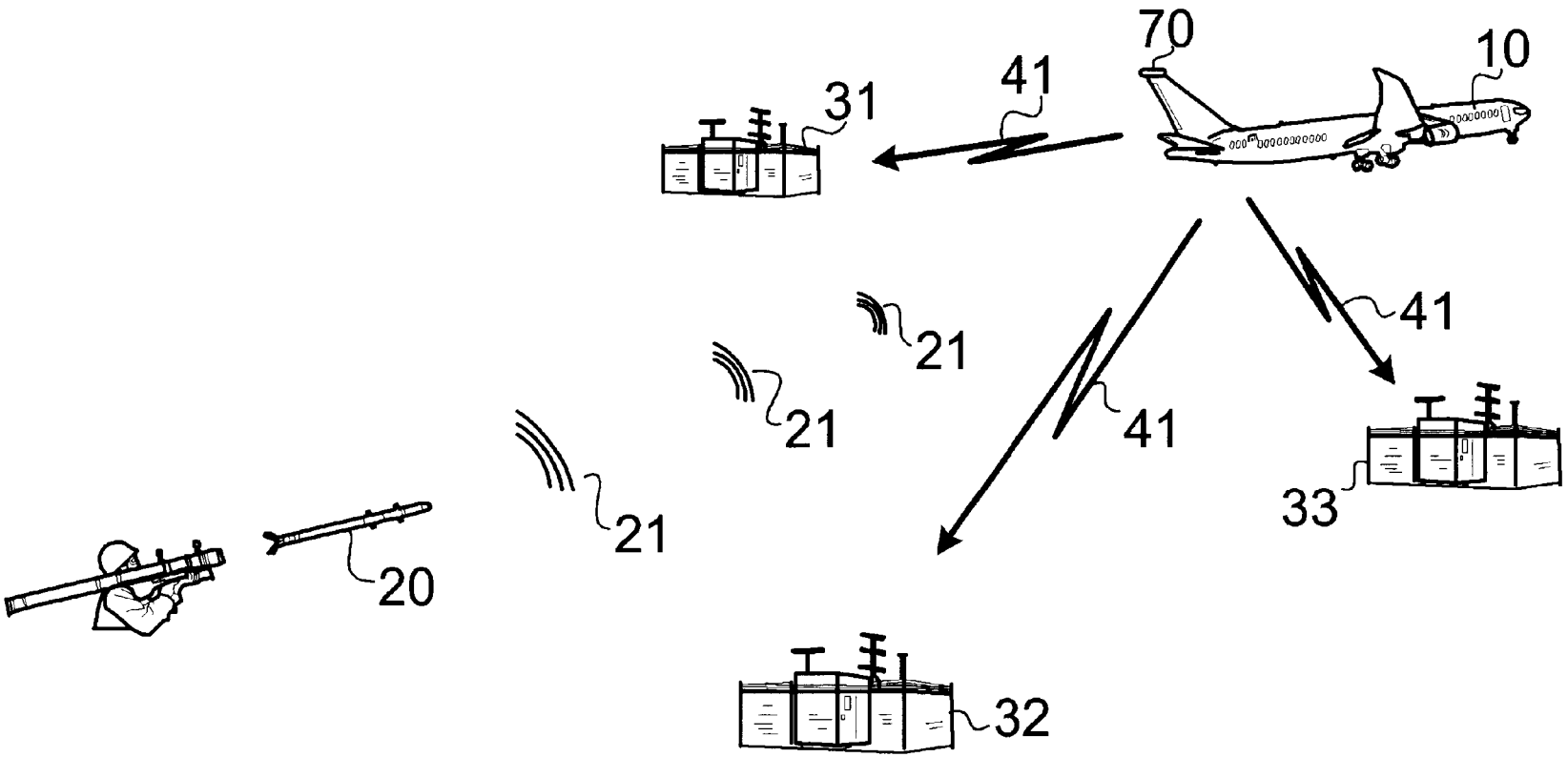
FIG. 1 illustrates a commercial airliner, carrying my inventive aircraft sensor package, and which is being targeted by a man portable missile.

The following is a list of the major elements in the drawings in numerical order.

5 raw sensor data
6 spectral signature
10 commercial airliner
20 man portable missile
21 detectable characteristic (of man portable missile)
31 first ground station
32 second ground station
33 third ground station
41 wireless data-link
51 exploded flare
60 turret (for firing flares)
61 flare dispenser
62 tracking mechanism
70 aircraft sensor package
71 missile sensor (part of aircraft sensor package)
72 reference frequency oscillator (part of aircraft sensor package)
73 modulator (part of aircraft sensor package)
74 data-link transmitter (part of aircraft sensor package)
75 aerodynamic enclosure (part of aircraft sensor package)
80 aircraft location processor
311 receiver (wireless data-link)
312 missile detection processor (at first ground station)
314 carrier phase processor (at first ground station)
711 optical aperture (part of aircraft sensor package)
712 prism means (part of spectral sensor)
713 spectral color bands
714 detector means (part of spectral sensor)
741 data-link antennas (part of aircraft sensor package)
810 step of moving airliner to survey position
820 step of transmitting raw sensor data and precise carrier signal
830 step of locking onto precise carrier signal and correlating airliner survey position
840 step of flying airliner on take-off trajectory
850 step of processing raw sensor data to determine missile launch
860 step of tracking turret aim-point behind airliner position
870 step of firing flare to aim-point elevation and azimuth angles
880 step of exploding flare at aim-point range position
distance from aircraft sensor package to first ground station
distance from aircraft sensor package to second ground station
distance from aircraft sensor package to third ground station

DETAILED DESCRIPTION OF THE INVENTION

Mode(s) for Carrying Out the Invention

Referring first to FIG. 1, a commercial airliner 10, such as, for example, a Boeing 737 taking off from an airport runway, is being fired on by a man portable missile 20. The airliner 10 includes an aircraft sensor package 70, in accordance with my invention. This aircraft sensor package 70 senses a detectable characteristic 21, such as a spectral signature, of the missile 20. Although the embodiments described below address spectral signature detection, those skilled in the art will recognize that the aircraft sensor package 70 could be configured to sense a wide variation of detectable characteristics including, but not limited to radar reflections, laser reflections, and radio frequency emanations. Raw data associated with the detectable characteristic is transmitted via wireless data link 41 to a first ground station 31, a second ground station 32, and a third ground station 33.

Figure 2:
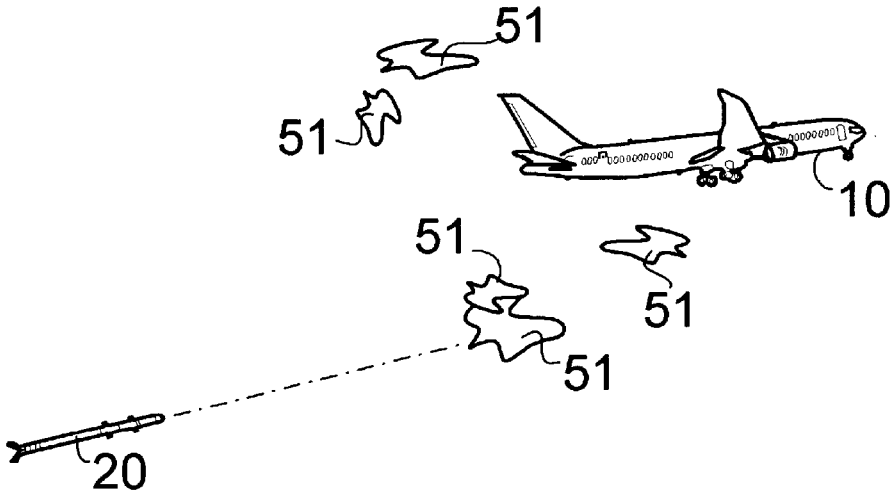
FIG. 2 shows the missile of FIG. 1 being diverted by an exploded flare in accordance with my invention.
Figure 3:
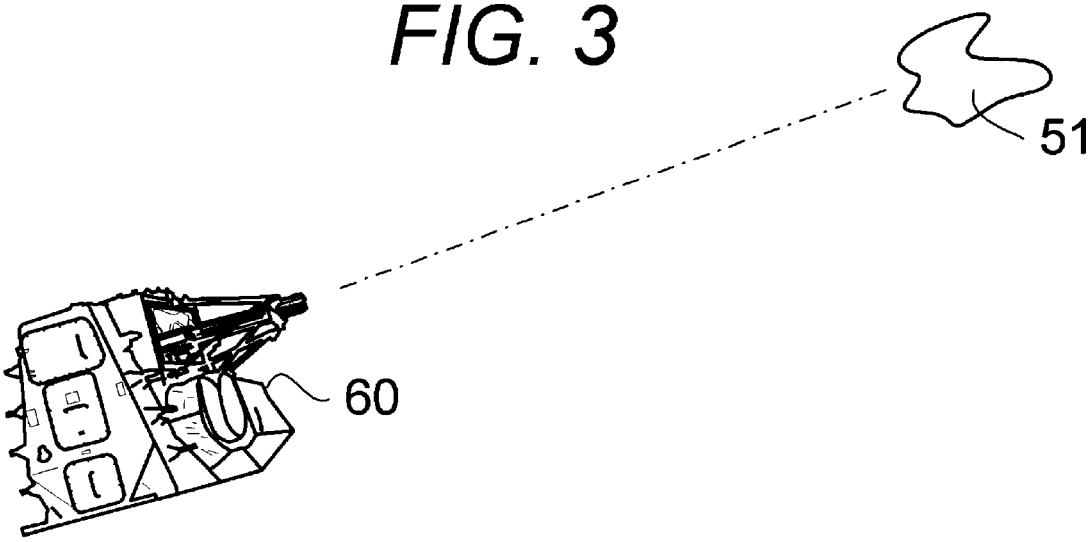
FIG. 3 depicts a turret firing the flare of FIG. 2.

Referring now to FIG. 2, the missile 20 is diverted from its intended target, commercial airliner 10, toward an exploded flare 51, which has been precisely aimed and detonated in the vicinity of the aircraft. FIG. 3 depicts a turret 60, similar to a US Navy Phalanx cannon, for firing flares where the turret is aimed to precisely track the airliner 10. The exploded flare 51 is detonated by the turret 60 at a precise range. More than one turret 60 may be positioned adjacent to the runway and tracking the airliner.

Figure 4:
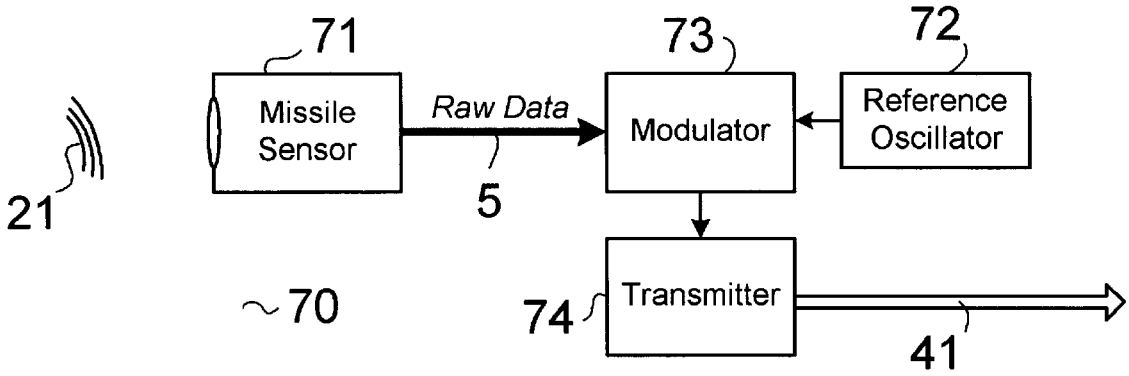
FIG. 4 is a functional block diagram of the aircraft sensor package of FIG. 1 in accordance with one illustrative embodiment of my invention.

FIG. 4 is a functional block diagram of a typical aircraft sensor package 70 in accordance with one illustrative my invention. In this embodiment, the aircraft sensor package 70 comprises a missile sensor 71, such as a spectral sensor, which provides raw data 5 to a modulator 73. Reference frequency oscillator 72 provides a precision carrier signal with known phase characteristics to modulator 73, where it is combined with raw sensor data 5 and then transmitted over a wireless data-link 41 via transmitter 74. In a preferred embodiment, the reference oscillator and transmitter are remotely tuned, such as for example from an air traffic control tower to a frequency between 108.000 MHz and 117.975 MHz, where the selected frequency corresponds to a VOR station that is not in the immediate geographic area.

Figure 5:
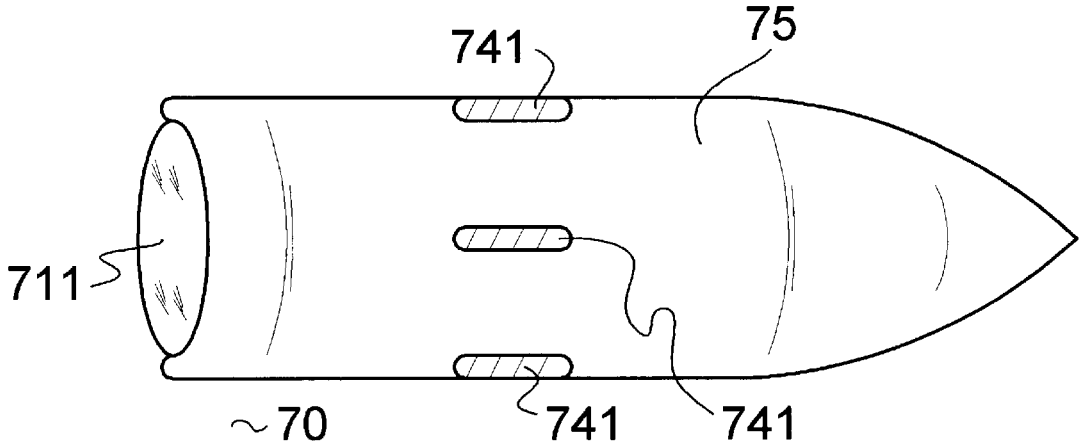
FIG. 5 is a perspective view of the aircraft sensor package of FIG. 1 in accordance with one illustrative embodiment of my invention.

FIG. 5 shows a perspective view of the illustrative aircraft sensor package 70 including optical aperture 711 and data-link antennas 741. The detectable characteristic 21, a spectral signature in this embodiment, enters optical aperture 711 and impinges on missile sensor 71. The wireless data-link 41 signal from transmitter 74 exits the aircraft sensor package 70 via antennas 741. In a preferred embodiment, antennas 741 are conformal to the aerodynamic enclosure 75 of the aircraft sensor package 70.

Figure 6:
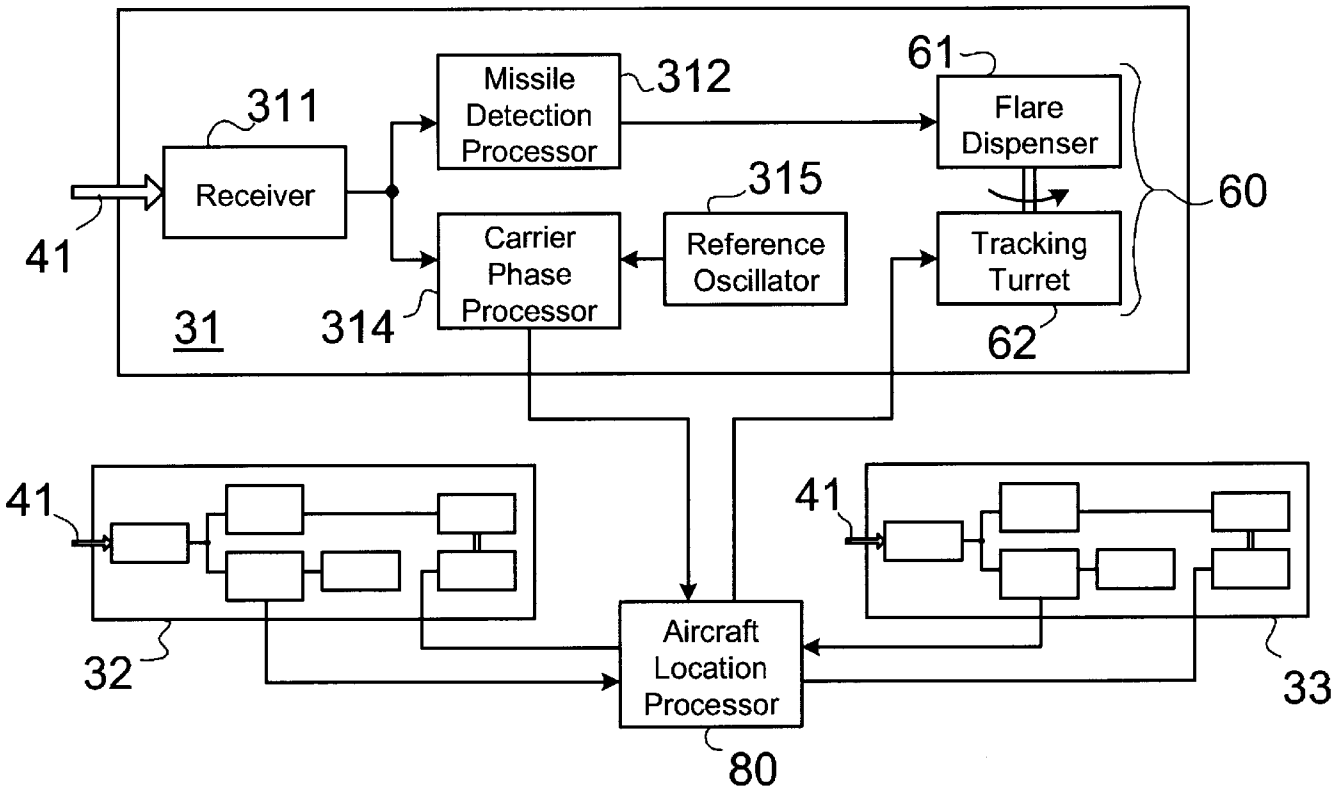
FIG. 6 is a functional block diagram of ground stations that are processing a wireless data-link from the aircraft sensor package of FIGS. 4 and 5.

Refer now to FIG. 6 which shows a functional block diagram of the ground stations and more particularly of the first ground station 31. The first ground station 31 includes a receiver 311 that receives the wireless data-link 41 from the aircraft sensor package 70. A first portion of the wireless data-link 41 exiting receiver 311 is routed to missile detection processor 312 which processes the raw sensor data included therein and determines whether a missile 20 is being detected. For example, certain missiles have solid rocket propellant including aluminum powder—detecting a spectral line at 396.152 nanometers (nm) may indicate the presence of aluminum oxide in a rocket plume.

A second portion of the wireless data-link 41 exiting receiver 311 is routed to carrier phase processor 314 which determines the distance from the first ground station 31 to the aircraft sensor package by counting the difference in the number of full carrier and partial cycles between the wireless data-link 41 and a reference oscillator 315. The difference in the number of full carrier cycles is measured using a zero crossing detector, and difference in the number of partial carrier cycles is measured by comparing the phase difference between the wireless data-link 41 and the reference oscillator 315. This carrier phase processing is analogous in operation to real-time kinematic tracking (RTK) techniques developed for surveying based on global positioning satellites (GPS). RTK tracks both the phase shift and full wave cycles differing between the receiver and transmitter. Therefore, it is possible to measure distances to an accuracy of a fractional wavelength. For example, in a preferred embodiment with the carrier frequency between 108.000 and 117.975 MHz a wavelength is approximately 2.5 meters long.

Figure 7:
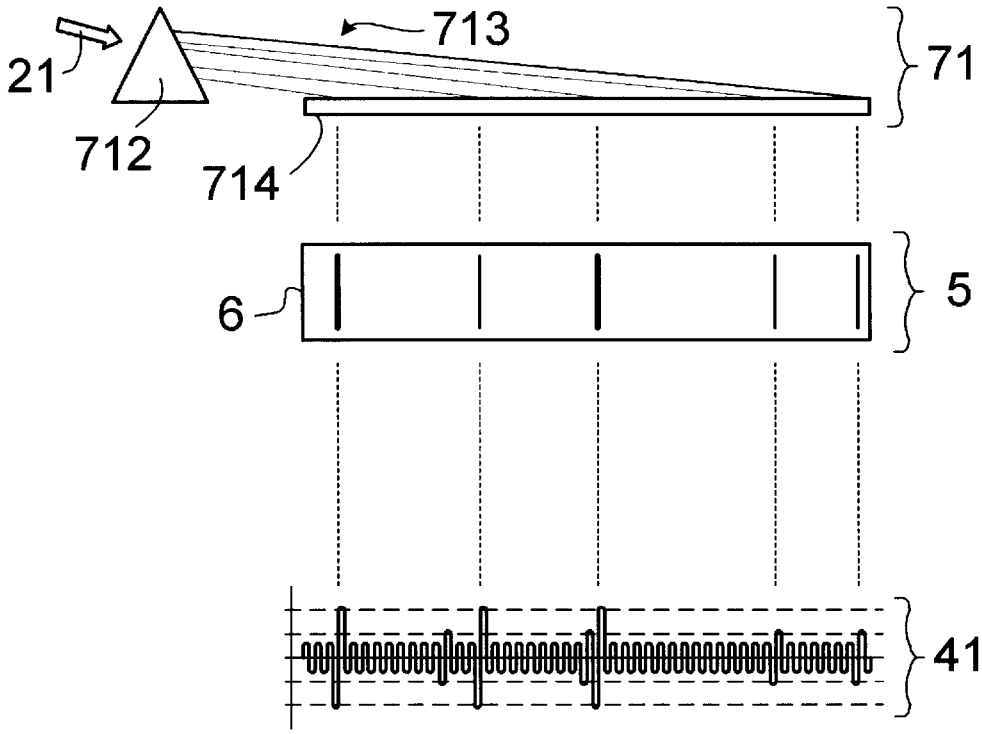
FIG. 7 is a block diagram of a missile sensor, such as a spectral sensor for use in the aircraft sensor package of FIGS. 4 and 5.

FIG. 7 is a block diagram of a missile sensor 71, such as a spectral sensor suitable for use in the aircraft sensor package of FIGS. 4 and 5. In this embodiment, incoming light is the detectable characteristic 21 of a missile, strikes a prism 712, is separated in spectral colors 713, and strikes detector plate 714. It will be recognized by those skilled in the art that a diffraction grating could be used instead of a prism and that a charge-coupled device (CCD) can be used as a light detector.

In embodiments of my invention using a spectral sensor, such as depicted in FIG. 7, the raw sensor data 5 comprises a spectral signature 6 which, as known to those skilled in the art, includes discrete light bands which can be used to identify a specific element, such as for example aluminum. The raw sensor data 5 is used to modulate a carrier signal that is transmitted as wireless data-link 41.

Figure 8:
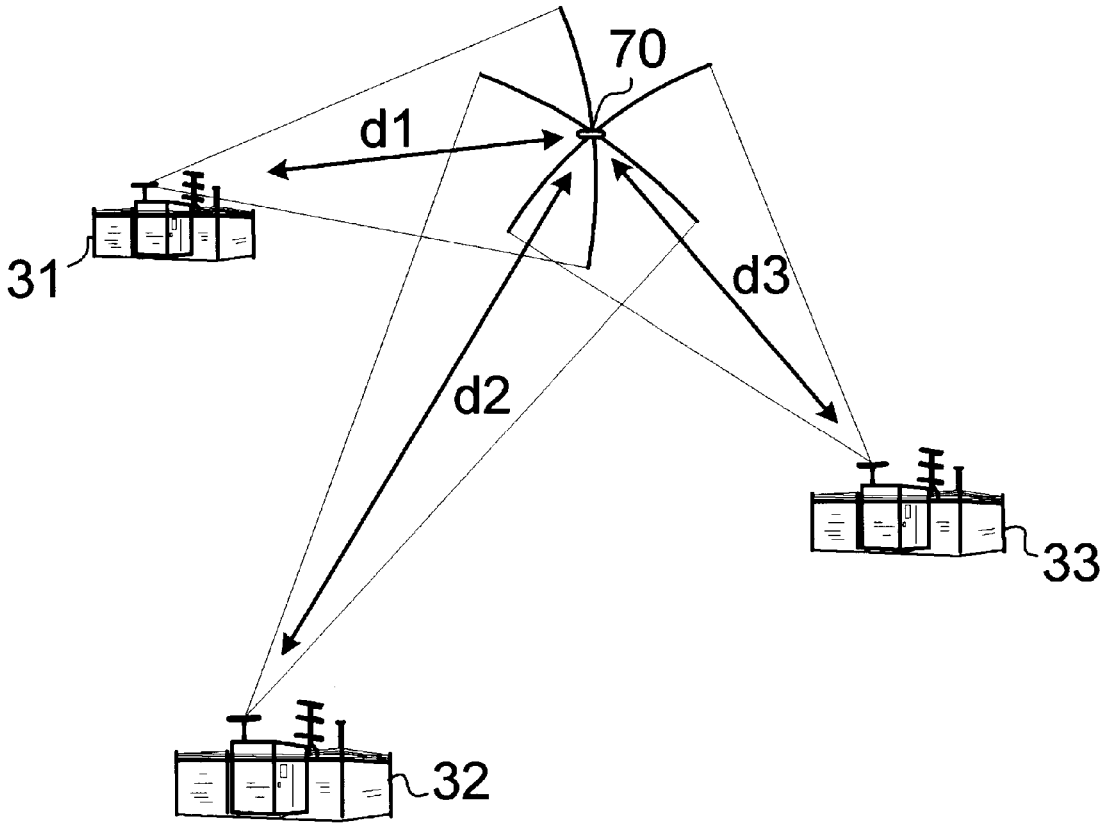
FIG. 8 pictorially depicts precisely locating a commercial airliner equipped aircraft sensor package in accordance with my invention.

FIG. 8 pictorially depicts precisely locating a commercial airliner equipped with an aircraft sensor package in accordance with my invention. In a preferred embodiment, the commercial airliner 10, shown in FIG. 1 includes at least one aircraft sensor package 70 including a transmitter that transmits a constant frequency signal within the range of standard VOR stations. The aircraft sensor package receives a radio command from air traffic control to start transmitting on a preselected carrier frequency. The first ground station 31 locks onto the carrier frequency and by using RTK techniques described above precisely measures the distance d1 between the first ground station 31 and the aircraft sensor package 70. In one embodiment, a reference starting distance is established when the aircraft sensor package 70 transmits from a known location such as 'position hold' at the runway threshold.

In a similar manner, the second ground station 32 measures the distance d2 between itself and the aircraft sensor package 70. The third ground station 33 measures the distance d3 between itself and the aircraft sensor package 70. Each of the distances d1, d2, and d3 defines a respective sphere in three-dimensional space. The point of intersection of these three spheres defines the aircraft location and is determined, by the aircraft location processor 80 shown in FIG. 6, using known techniques of linear algebra.

Figure 9:
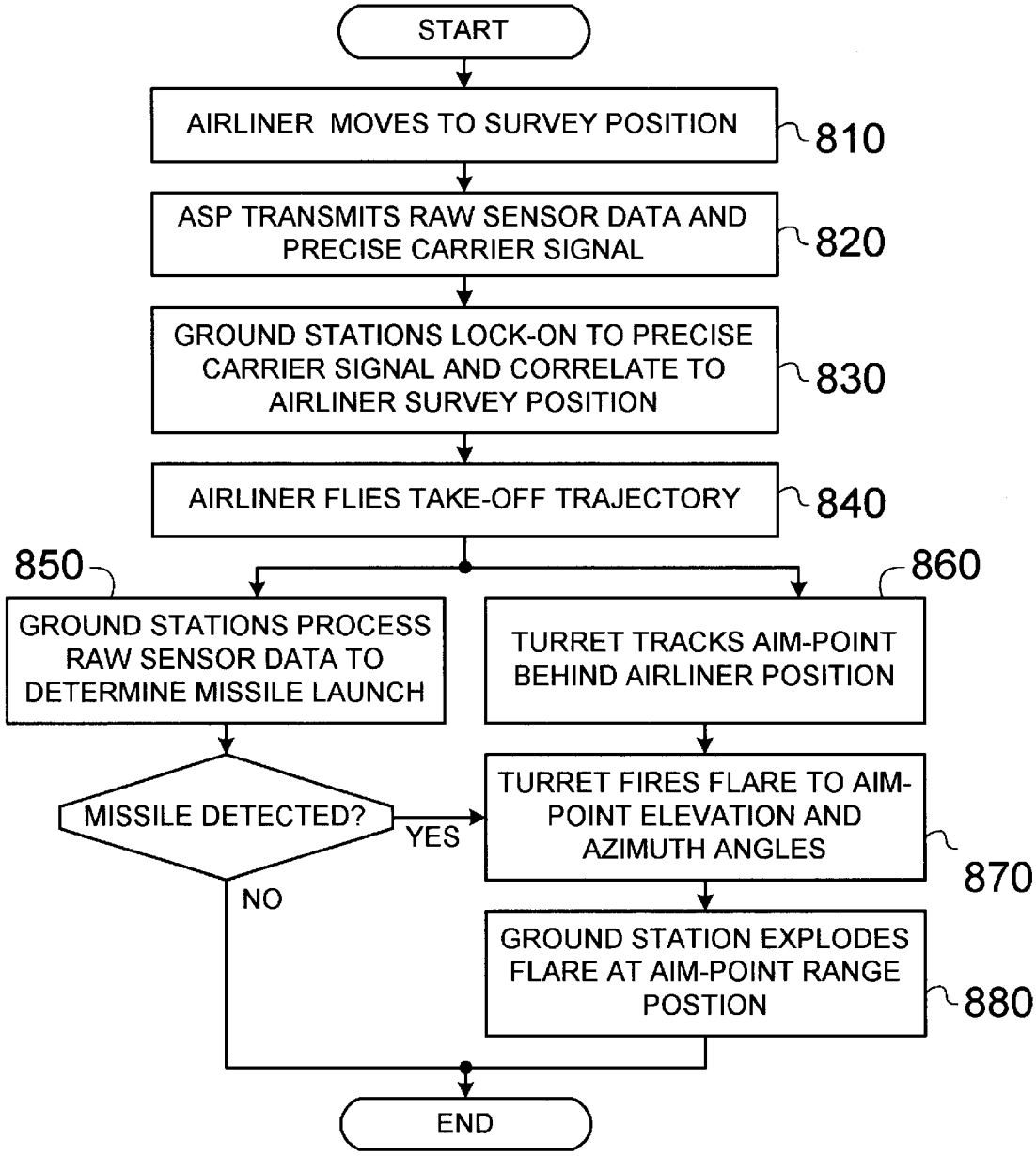
FIG. 9 shows the steps of an illustrative method of protecting commercial from man portable missiles using the system of FIGS. 1–8.

Refer now to FIG. 9, which shows the steps of an illustrative method of protecting commercial airliners from man portable missiles using the system of FIGS. 1–8. The commercial airliner 10 is first moved (step 810) to a survey position, such as the 'position hold' on an airport taxiway, which position has a location that has been determined to a high degree of accuracy, such as for example within +/−0.1 meters in three geographical coordinates. It is important that the aircraft sensor package (ASP) 70 has a clear line-of-sight to each of the ground stations 31–33 while the airliner 10 is located at the survey position. Next, the aircraft sensor package (ASP) begins to transmit (step 820) raw sensor data and a precise carrier signal, collectively described above as the wireless data-link 41. In a preferred embodiment of my invention the ASP 70 is both remotely commanded to start transmitting and remotely tuned to an appropriate carrier frequency such as a VOR frequency that is not being used by the airport where the airliner 10 is presently located.

Next, the ground stations 31–33 lock-on to the precise carrier signal and correlate their calculated aircraft position with the survey position. The use of a survey position allows each ground station to track the actual number of complete radio frequency cycles using the following relationship.

Number of Cycles=INT (geographic distance/wavelength of the carrier);

where INT is a mathematical function computing the integral, or whole number, portion of its argument.

The ground stations constantly receive the carrier frequency from when the ASP 70 starts transmitting at the survey point till when the airliner 10 leaves the protected zone. This allows each ground station to measure both the number of RF cycles of the carrier as well as an RF phase shift, which is equivalent to a partial cycle. This method of measuring precise distance using full and partial cycles will be familiar to those skilled in the art of real-time kinematics, such as is used in the field of surveying using global positioning system (GPS) satellites. Advantageously, by measuring both full and partial RF carrier cycles, the distances d1–d3 from the ground stations 31–33 can be measured with a high level of accuracy such as +/−0.1 meter.

Next, the airliner flies (step 840) and the ground stations 31–33 use the precise distance measurements d1–d3, as described above, to accurately track the airliner 10 geographic position in three dimensions. As the airliner 10 flies the take-off trajectory, the ground stations receive and process (step 850) the raw sensor data 5 contained in wireless data-link 41. Also, as the airliner 10 flies the take-off trajectory, each turret 60, if more than one is employed, targets and tracks a predetermined aim-point behind the airliner 10. This aim-point corresponds to where an exploded flare 51, shown in FIG. 2, would be in a position to divert a missile 20 if and when such a missile is detected. As will be appreciated by those skilled in the art of military aircraft counter-measures, the dispersion pattern of exploded flares optimally positioned to divert a missile is dependent on the configuration of the airliner 10.

If a missile 20 is detected, the turret or turrets 60 fire (step 870) a flare at the aim-point described previously. Specifically, the turret 60 determines both the elevation and azimuth angle along which the flare travels toward the aim-point. The ground station commands, such as by radio command, the flare to explode (step 880) at the range of the aim-point from the turret 60. In one embodiment, the command to explode the flare is determined by the muzzle velocity of the flare leaving the turret 60 and an elapsed time. In another preferred embodiment of my invention, the ground station (31–33) radar-tracks the flare leaving the turret 60 and commands the flare to explode based on its observed position. Advantageously, by tracking the flare leaving the turret 60, it is possible to preventively explode or not explode any flare that is off-course.

It will be recognized by those skilled in the art that data latency, such as time between when the missile 20 is 'seen' by the missile sensor 71 and when the exploded flare 51 presents an alternative target to the missile, is an important factor to be considering during the fielding of my invention. In one embodiment of my invention, the missile sensor 71 is a camera operating at 30 frames per second and provides live raw data to the ground stations 31–33 with a lag time of 30 milliseconds. The transit time for the RF wireless data link 41 to the ground stations 31–33 is approximately 10 microseconds, assuming a 2 mile (3.2 kilometer) range where the speed of light, or RF energy, is about 1 mile (1.6 kilometer) every 5 microseconds. In this embodiment, the ground stations 31–33 share and process data at 10 Hertz resulting in a 100-millisecond data frame. Also in this embodiment, detection of the missile and the resultant command for the turret 60 to fire requires four consecutive data frames resulting in a total processing time delay of 400 milliseconds. The flare 51 is a modified high velocity round having a muzzle velocity of 2500 feet per second (762 meters per second) and the airliner 10 is, on average, 5000-foot (1524 meter) slant range from the turret 60, resulting in a flare flight time of 2 seconds.

Therefore, the total data latency for this one illustrative embodiment, including sensor 71 delay, RF wireless data link 41 transit time, ground stations 31–33 processing time, and flare 51 flight time is approximately 2.4 seconds. In these 2.4 seconds, a missile 20 traveling 1200 miles per hour (536 meters per second) at an airliner 10 moving away from the missile at 240 miles per hour (107 meters per second) traveling will have closed the distance between itself and the airliner by 3500 feet. In this embodiment, sensor 71 and the corresponding detection processing algorithm in ground stations 31–33 is selected such that detection of the missile 20 occurs at a range from the airliner 10 greater than 7000 feet (2133 meters) and countermeasures, such as flare 51, are in position at a missile 20 range from the airliner 10 greater than 3500 feet (1066 meters).

In a further embodiment of my invention, the commercial airliner 10 is equipped with multiple aircraft sensor packages 70 where each aircraft sensor package transmits on a unique carrier frequency which advantageously allows the ground stations 31, 32, and 33 to determine both precise airliner 10 position and pitch, roll and heading attitude. These aircraft sensor packages are remotely controlled by air traffic control and only transmit while the airliner 10 is in a protected area. In a preferred embodiment of my invention, the carrier frequency is also remotely selected by air traffic control and is within the already allocated radio navigation frequency band of 108.000 to 117.975 MHz.

List of Acronyms Used in the Detailed Description of the Invention

The following is a list of the acronyms used in the specification in alphabetical order.

ASP aircraft sensor package
CCD charge-coupled device
GPS global positioning system
INT integer portion of (mathematical function)
MHz megahertz
nm nanometers
RF radio frequency
RTK real-time kinematic tracking (carrier signal phase processing)
VOR very high frequency omni-directional radio (radio navigation aid)

Alternate Embodiments

Alternate embodiments may be devised without departing from the spirit or the scope of the invention. For example, the commercial airliner 10 could be equipped with a rear facing radar transmitter and the raw sensor video could consist of radar returns.

What is claimed is:

1. A system for protecting a commercial airliner (10) from a man portable missile (20) comprising:

(a) an aircraft sensor package (70) located on an airliner and including a missile sensor (71), a reference frequency oscillator (72), and a transmitter (74), said aircraft sensor package adapted to transmit a wireless data-link (41) which includes raw sensor data (5) and a precise carrier frequency;

(b) a plurality of ground stations (31–33) adapted to receive said raw sensor data and determine the presence of a missile therefrom and also adapted to receive said precise carrier frequency and determine the location of said airliner therefrom; and (c) a turret (60) adapted to track said airliner as it flies through a protected zone, said turret further adapted to lay down a predetermined pattern of exploding flares (51) to divert said missile away from said airliner.

2. A method for protecting a commercial airliner (10) from a man portable missile (20), said method comprising:

(a) moving (step 810) an airliner to a survey position whose location has been accurately predetermined;

(b) transmitting (step 820) a signal from the airliner, said signal comprising raw sensor data (5) and a precise radio frequency carrier;

(c) receiving (step 830) the signal at a ground station (31–33) and correlating said signal to said survey position;

(d) flying (step 840) the airliner along a take-off trajectory;

(e) processing (step 850) said sensor data to determine whether a missile has been launched;

(f) tracking (step 860) a turret to an aim-point behind said airliner;

(g) firing (870) a flare from the turret at the aim-point when a missile has been detected; and (h) exploding (step 880) said flare at the aim-point range, thereby diverting said missile.

3. The method of claim 2 wherein the step of correlating said signal further comprises determining the number of full and partial cycles of said carrier that correspond to a known distance between said ground station and said survey position.

4. A method for protecting an airplane from a ground missile when the airplane is moving at an airport, said method comprising the steps of:

(a) accurately determining the location of a survey position at the airport;

(b) transmitting data from the airplane to a plurality of ground stations as the airplane departs from the survey position;

(c) determining from said data both whether a missile has been fired at the airplane and the exact position of the airplane as determined in relation to the survey position; and (d) if a missile has been fired at the airplane, firing one or more flares to intercept the missile.

5. The method of claim 4 wherein said transmitted data includes a precise radio frequency carrier and said determining step includes determining the number of full and partial cycles of the carrier that correspond to known distances between each ground station and the survey position.

6. The method of claim 5 wherein the survey position is on the runway of the airport and the airplane is taking off from the airport on that runway.

7. The method of claim 6 wherein each ground station locks on to the precise radio frequency carrier.

8. The method of claim 7 further comprising a ground station exploding the flare that has been fired.

* * * * *